US012286867B2

(12) United States Patent
Cook et al.

(10) Patent No.: US 12,286,867 B2
(45) Date of Patent: Apr. 29, 2025

(54) SELF-SHUNTING DETONATOR FOR WELL PERFORATING GUN

(71) Applicant: Halliburton Energy Services, Inc., Houston, TX (US)

(72) Inventors: Kevin C. Cook, Alvarado, TX (US); Matthew Craig Mlcak, Alvarado, TX (US); Joseph Todd MacGillivray, Alvarado, TX (US); Stuart Michael Wood, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 17/988,913

(22) Filed: Nov. 17, 2022

(65) Prior Publication Data

US 2024/0167368 A1 May 23, 2024

(51) Int. Cl.

| | |
|---|---|
| ***E21B 43/1185*** | (2006.01) |
| ***E21B 43/117*** | (2006.01) |
| ***F42D 1/05*** | (2006.01) |
| *F42C 15/34* | (2006.01) |

(52) U.S. Cl.

CPC ..... *E21B 43/1185* (2013.01); *E21B 43/117* (2013.01); *F42D 1/05* (2013.01); *F42C 15/34* (2013.01)

(58) Field of Classification Search

CPC ..... E21B 43/117; E21B 43/1185; E21B 43/119; E21B 43/116; E21B 43/112; E21B 17/028; E21B 34/063; E21B 34/10; F42D 1/05; F42B 3/182; F42C 15/34

USPC ..... 102/202.1–209

See application file for complete search history.

(56) References Cited

U.S. PATENT DOCUMENTS

| | | | | |
|---|---|---|---|---|
| 4,208,966 | A * | 6/1980 | Hart | F42D 1/055 340/856.4 |
| 5,533,454 | A * | 7/1996 | Ellis | F42D 1/05 102/202.7 |
| 5,791,923 | A | 8/1998 | Picaud et al. | |
| 6,179,064 | B1 | 1/2001 | Vaynshteyn | |
| 9,605,937 | B2 | 3/2017 | Eitschberger et al. | |

(Continued)

FOREIGN PATENT DOCUMENTS

WO 2021263223 12/2021

OTHER PUBLICATIONS

Thilo Scharf, "New System Raises Perforation Safety," The American Oil & Gas Reporter, Mar. 2019, Houston TX.

(Continued)

*Primary Examiner* — Michael D David

(74) *Attorney, Agent, or Firm* — John Wustenberg; C. Tumey Law Group PLLC

(57) ABSTRACT

Various well-perforating systems and methods are disclosed incorporating a self-shunting detonator. The detonator may include an electrically-conductive detonator body. A resistor initiator inside the detonator body includes first and second leads. A grounding element inside the detonator body couples the detonator body to the first lead. An electrically-conductive clip coupled to the second lead includes an arm biased to electrical contact with an external surface of the detonator body to shunt the detonator. The arm is moveable away from the detonator body to un-shunt the detonator, such as automatically in response to insertion into a detonator housing.

16 Claims, 4 Drawing Sheets

(56) References Cited

U.S. PATENT DOCUMENTS

| | | | | |
|---|---|---|---|---|
| 9,851,191 | B2 | 12/2017 | Erche et al. | |
| 10,472,937 | B2 | 11/2019 | Walters et al. | |
| 10,557,693 | B2 * | 2/2020 | Lerche | E21B 43/11855 |
| 10,612,352 | B2 | 4/2020 | Tolman et al. | |
| 10,876,381 | B2 | 12/2020 | Walters et al. | |
| 10,920,541 | B2 | 2/2021 | Robey et al. | |
| 11,174,690 | B2 | 11/2021 | Robey et al. | |
| 11,174,712 | B2 | 11/2021 | Quattlebaum et al. | |
| 11,313,208 | B2 | 4/2022 | Hoelscher et al. | |
| 11,352,860 | B2 | 6/2022 | MacGillivray | |
| 11,353,308 | B2 | 6/2022 | Lopez De Cardenas et al. | |
| 11,359,468 | B2 | 6/2022 | Roberts et al. | |
| 11,391,126 | B2 * | 7/2022 | Dyess | E21B 43/117 |
| 11,460,281 | B2 | 10/2022 | Tillman et al. | |
| 11,486,234 | B2 | 11/2022 | Macgillivray | |
| 11,492,878 | B2 * | 11/2022 | Sokolove | H01R 13/7033 |
| 11,591,885 | B2 * | 2/2023 | Eitschberger | E21B 43/1185 |
| 11,719,518 | B2 * | 8/2023 | Macgillivray | F42B 3/103 102/200 |
| 11,913,310 | B2 * | 2/2024 | Masters | F42D 1/055 |
| 11,982,163 | B2 * | 5/2024 | Dyess | E21B 43/117 |
| 12,031,417 | B2 * | 7/2024 | Eitschberger | E21B 43/117 |
| 2004/0108114 | A1 * | 6/2004 | Lerche | E21B 47/12 166/302 |
| 2012/0199031 | A1 * | 8/2012 | Lanclos | F42D 1/055 102/206 |
| 2013/0248174 | A1 * | 9/2013 | Dale | E21B 47/04 166/65.1 |
| 2014/0182841 | A1 | 7/2014 | Lecerf et al. | |
| 2016/0178334 | A1 | 6/2016 | Bonavides et al. | |
| 2016/0215596 | A1 | 7/2016 | Cook et al. | |
| 2016/0237793 | A1 | 8/2016 | Albers et al. | |
| 2017/0211363 | A1 * | 7/2017 | Bradley | F42B 5/035 |
| 2020/0018584 | A1 * | 1/2020 | Phelps | E21B 43/1185 |
| 2020/0277843 | A1 | 9/2020 | MacGillivray et al. | |
| 2021/0054724 | A1 | 2/2021 | Robey et al. | |
| 2021/0164331 | A1 | 6/2021 | Sokolove et al. | |
| 2021/0372744 | A1 | 12/2021 | MacGillivray et al. | |
| 2021/0396103 | A1 | 12/2021 | MacGillivray et al. | |
| 2022/0025744 | A1 | 1/2022 | Azar et al. | |
| 2022/0106861 | A1 | 4/2022 | Watkins et al. | |
| 2022/0127935 | A1 | 4/2022 | Grove et al. | |
| 2022/0356789 | A1 | 11/2022 | Sokolove et al. | |

OTHER PUBLICATIONS

International Search Report and Written Opinion for International Application No. PCT/US2022/054392 dated Aug. 23, 2023.

* cited by examiner

SELF-SHUNTING DETONATOR FOR WELL PERFORATING GUN

BACKGROUND

Wells are often drilled to extract hydrocarbons, such as oil and gas. After drilling a wellbore that traverses a hydrocarbon-bearing formation, a casing string is installed to reinforce portions of the wellbore. A casing string comprises large diameter metal tubulars that are connected end to end, lowered into the wellbore, and cemented in place. The casing string increases the integrity of the wellbore and provides a structure for supporting other wellbore equipment such as production tubing used for producing fluids from one or production zones of the formation to surface. When a production zone is lined with casing, the casing must be perforated in order for formation fluids to enter the wellbore.

Perforating involves creating hydraulic openings that extend through the casing and into the surrounding formation. Typically, perforations are created by lowering a perforating gun string downhole and detonating a series of explosive shaped charges adjacent to the production zone. For safety, perforating guns may be transported to a wellsite in a partially unassembled state to prevent accidental detonation. Once fully assembled at the wellsite, a perforating gun string may be lowered into the cased wellbore on an appropriate conveyance, such as a wireline. An explosive train is then initiated to detonate the shaped charges in a predetermined fashion. The perforating gun string may then be retrieved to the surface.

Modular perforating systems used in wireline applications conventionally utilize a detonation device with an integrated switch. These switches come in different sizes and configurations. Such detonator designs require additional shunt wires to connect between positive and ground connections via a printed circuit board (PCB). This has led to detonators having cumbersome housing and PCBs with soldered connections in order to join together the electrical connections needed to arm the device.

BRIEF DESCRIPTION OF THE DRAWINGS

These drawings illustrate certain aspects of some of the example configurations of the present disclosure and should not be used to limit or define the method.

DETAILED DESCRIPTION

A perforating system and method are disclosed incorporating a self-shunting, clip-on, resistorized detonator in a compact, modular packaging. The disclosure includes a detonator module with a self-shunting clip. The clip includes an arm that makes external contact with an electrically conductive detonator body to effectively shunt the explosive device from unintended electrical currents that might otherwise flow through the detonator and cause an accidental discharge. The clip is automatically un-shunted by separating the arm from the detonator body in response to inserting the detonator into a detonator housing. In its normally shunted state, any inadvertent electrical current will be diverted along the shunted circuit path, bypassing the explosive material inside the detonator. Once un-shunted by insertion of the detonator into the detonator housing, a detonation signal may be transmitted to the detonator along the un-shunted circuit path for initiation of explosive material. The initiation of the explosive material inside the detonator may then trigger a detonation train leading to the firing of perforating charges.

Figure 1:
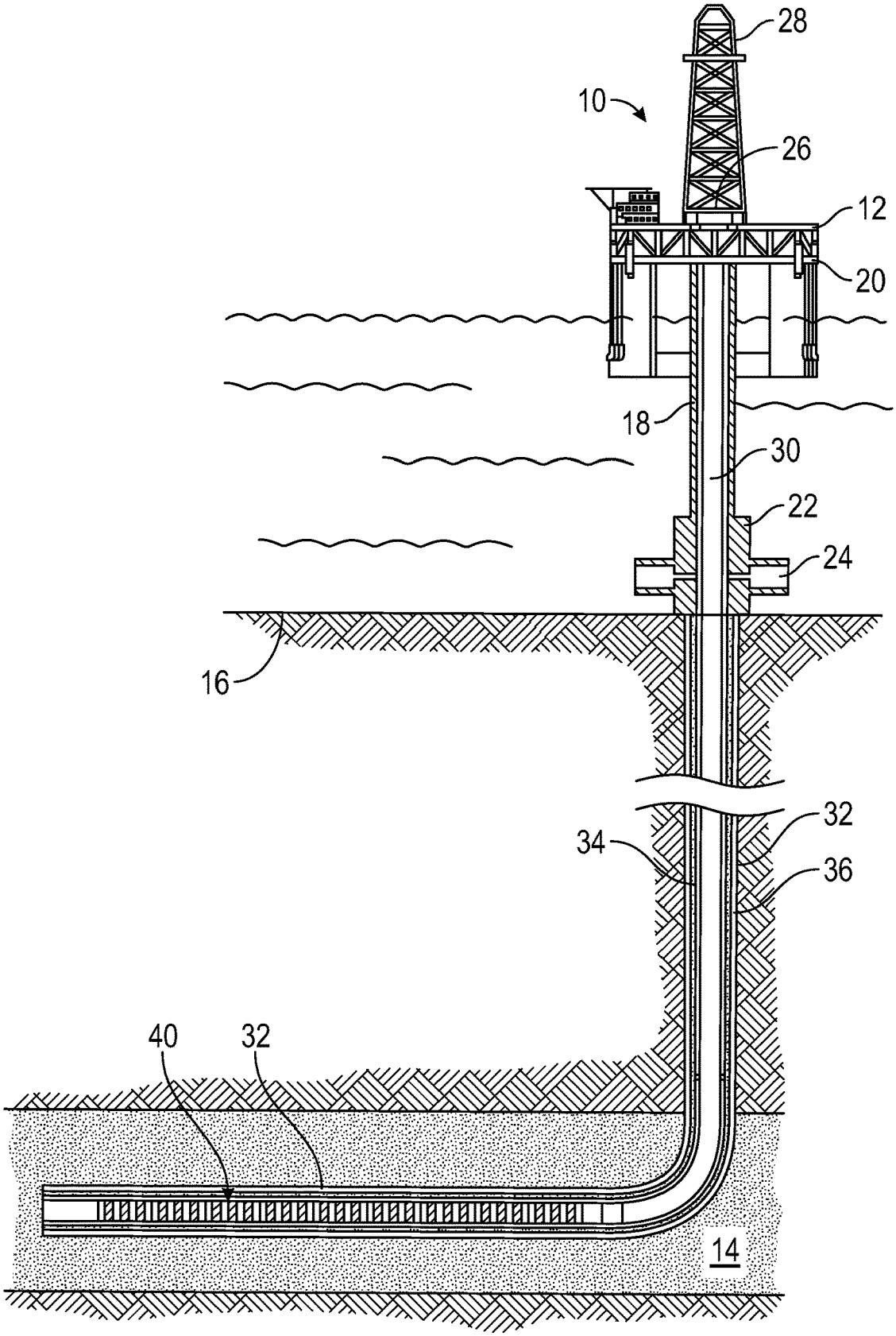
FIG. 1 is an elevation view of a wellsite in which a well perforating system and method according to this disclosure may be implemented.

FIG. 1 is an elevation view of a wellsite 10 as an example environment in which a well perforating system and method according to this disclosure may be implemented. The wellsite 10 is depicted by way of example as an offshore wellsite. However, aspects of this disclosure are relevant to perforating with any type of wellsites that may utilize perforating systems, including offshore or land-based oil and gas drilling and production. The wellsite 10 includes a semisubmersible platform 12 centered over a submerged oil and gas formation 14 located below sea floor 16. A subsea conduit 18 extends from a deck 20 of the semi-submersible platform 12 to a wellhead installation 22 that includes subsea blow-out preventers 24. The semi-submersible platform 12 has a hoisting apparatus 26 and a derrick 28 for raising and lowering pipe strings such as work string 30. The work string 30 may be used as a conveyance for a perforating gun in this case, although any suitable conveyance may be used depending on the situation, such as a wireline, slick line, tubing string, or coiled tubing. A wellbore 32 extends through the various earth strata of the formation 14. The wellbore 32 may be drilled with any given wellbore path. In this example, the wellbore 32 has a generally vertical portion from the sea floor 16 and a horizontal section below that.

A wellbore casing 34 is cemented within a wellbore 32 by cement 36, which lines and reinforces the wellbore 32. The casing 34 may be perforated for formation fluids to enter the wellbore 32 in the vicinity of the casing 34. The tubular work string 30 may provide various tools involved in perforating, such as a plurality of perforating guns schematically depicted at 40, along with electrical power and signal communication pathways. To perforate the casing 34, the work string 30 may be lowered through casing 34 until the perforating guns 40 are positioned as desired relative to the formation 14. Thereafter, the shaped charges within the string of perforating guns 40 are sequentially fired, either in an uphole to downhole or a downhole to uphole direction. Upon detonation, the liners of the shaped charges form jets that create a spaced series of perforations extending outwardly through the casing 34, cement 36 and into the formation 14. These perforations allow fluid communication between the formation 14 and the wellbore 32.

Figure 2:
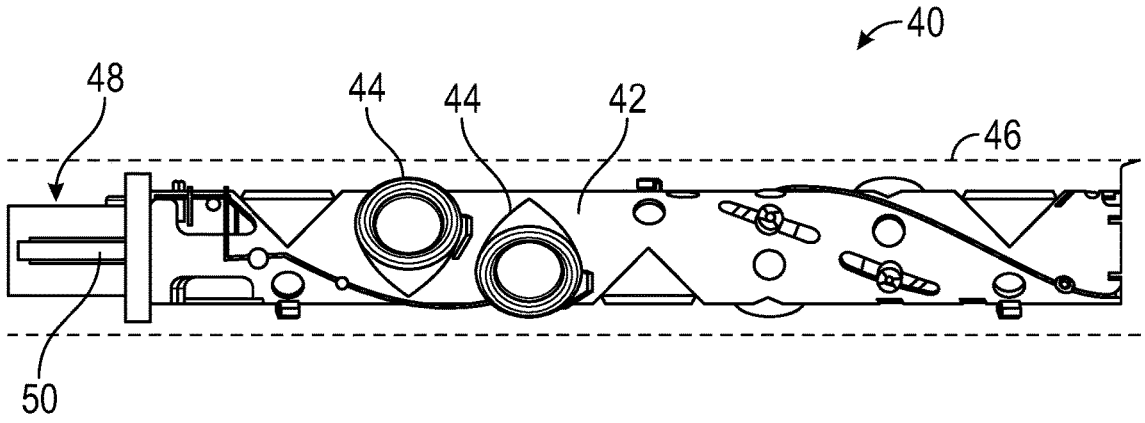
FIG. 2 is a side view of a perforating gun according to an example configuration.

FIG. 2 is a side view of a perforating gun 40 according to an example configuration that may incorporate aspects of this disclosure. The perforating gun 40 may be one of a plurality of perforating guns connected end to end to achieve a perforating gun string. The perforating gun 40 includes a charge carrier 42 to which a plurality of perforating charges 44 are secured at different positions and firing orientations along the charge carrier 42. The charge carrier 42 has a generally continuous tubular construction in this example, and may be alternatively referred to as a charge tube in that context. However, all other suitable charge carrier configurations are also within the scope of this disclosure, such as modular charge carriers formed by snapping together or otherwise interconnecting any number of charge carrier segments that each hold one or more perforating charges within a perforating gun. A detonator housing schematically shown at 48 is secured to an end of the charge carrier 42. The detonator housing 48 may be one of the parts of a perforating gun assembly that may be removably coupled to the end of the charge carrier 42. The detonator housing 48 removably receives and secures a modular detonator 50. The detonator housing 48 may include other features for facilitating assembly, such as to position a detonating cord (not shown) in relation to the detonator 50. The charge carrier 42 and components assembled thereon may be positioned inside a protective gun body schematically indicated at 46 for lowering the perforating gun or gun string into a wellbore on a wireline or other conveyance.

Figure 3:
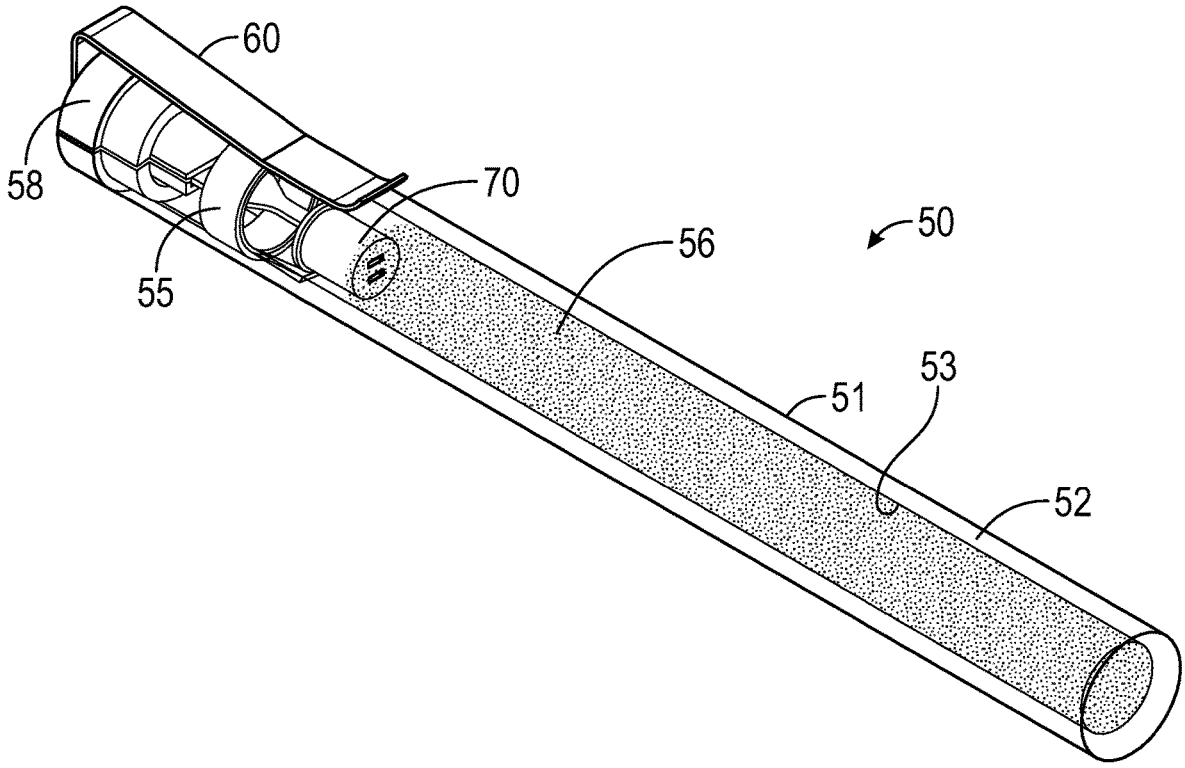
FIG. 3 is a perspective view of the detonator according to an example configuration.

FIG. 3 is a perspective view of the detonator 50 according to an example configuration. The detonator 50 is modular, at least in that it is removably received within a detonator housing (such as shown in FIG. 1) for ease of assembly. The detonator 50 includes functionality enabled by virtue of insertion into the detonator housing. For example, as discussed below, the detonator 50 is shunted by default, for safety reasons, and is un-shunted when inserted within its corresponding detonator housing in a perforating gun assembly. The shape and form factor is relatively compact, in part because the configuration avoids a need for a PCB and/or switch to be directly mechanically coupled to the detonator 50. Thus, a quantity of the detonators 50 may be supplied and transported in quantity with a relatively high part count for a given packaging volume. This allows for economical storage and transport, as well as safe storage and transport given the disclosed safety features.

The detonator 50 includes an electrically conductive detonator body 52 having an outer surface 51 with an outer diameter (OD) and an inner surface 53 having an inner diameter (ID). The detonator body 52 may comprise a ferrous material that provides electrical conductivity and is economical to produce. Alternative configurations also within the scope of this disclosure could incorporate a non-conductive shell (e.g., a plastic or composite material) with electrically conductive circuit paths or traces arranged thereon to provide the electrical conductivity. A resistor initiator 70 is disposed inside the detonator body 52 adjacent an explosive material 56. A insulator cap 58 is provided at an end of the detonator body 52. The insulator cap 58 optionally overlaps with the outer surface 51 (e.g., the OD) and inner surface (e.g., the ID) of the detonator body 52 to provide a tight fit with the detonator body 52. A grounding element 55 inside the detonator body 52 couples the detonator body 52 to a first lead of the resistor initiator 70. An electrically-conductive clip 60 is assembled to the detonator 50 to shunt the detonator 50 as further described below, so that any unexpected electrical phenomena that may apply an electrical current and/or voltage to the detonator body 52 is unlikely to initiate the explosive material 56 inside the detonator body 52.

Figure 4:
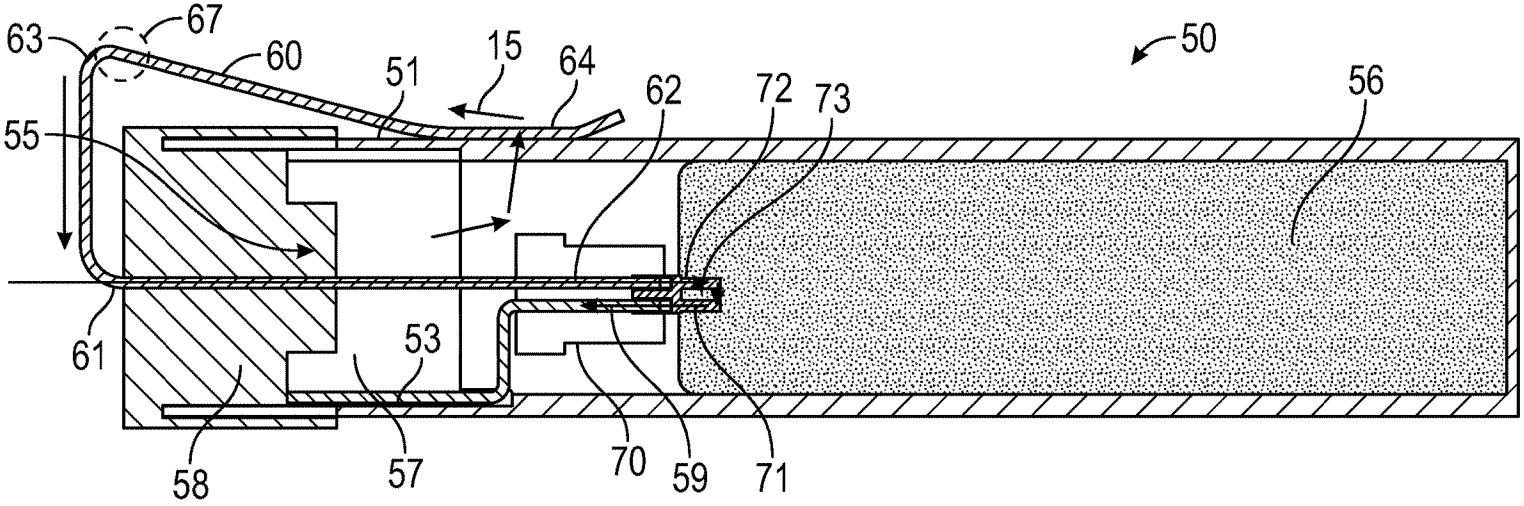
FIG. 4 is a sectional side view of the detonator of FIG. 3 in its default shunted state.

FIG. 4 is a sectional side view of the detonator 50 of FIG. 3 in its default shunted state. The resistor initiator 70 has a pair of electrical leads 71, 72 and a resistor wire (i.e., bridge wire) 73 that may be heated by electrical current to initiate the explosive material 56. However, in this default shunted state, the resistor initiator 70 is effectively short-circuited through the detonator body 52 via the grounding element 55 and the clip 60 to avoid heating the bridge wire 73 to this level. In particular, the grounding element comprises a circular or semi-circular grounding body 57 frictionally engaging the inner surface 53 of the detonator body 52, which both places the grounding element 55 in electrical contact with the detonator body 52 and helps secure the grounding element 55 in place in the detonator body 52. The grounding element 55 has a grounding lead 59 coupled to the first lead 71 of the resistor initiator 70. The clip 60 has an interior portion 62 coupled to the second lead 72 of the resistor initiator 70 inside the detonator body 52. An arm 64 of the clip 60 is biased toward electrical contact with the outer surface 51 of the detonator body 52, and thus self-shunting. This results in a closed-loop circuit path indicated by arrows 15 through the grounding element 54, the detonator body 52, and the clip 60 to shunt the detonator 50. The shunting may prevent any appreciable current flow across the resistor initiator 70, thereby bypassing the resistor wire 73, at least keeping any electrical flow in the resistor wire 73 below a threshold value that would initiate the explosive material 56.

The clip 60 is optionally a unitary, electrically-conductive structure that is particularly shaped to efficiently and compactly extend from the arm 64, where it externally contacts the detonator body 52, to an end inside the detonator body 52, where the clip 60 couples to the resistor initiator 70. More particularly, the interior portion 62 of the clip 60 is a straight section that extends from the resistor initiator 70 to where it exits the detonator body 52 through the insulator cap 58. After exiting the insulator cap 58, the clip 60 includes a first bend 61 to route the clip 60 close to the insulator cap 58, and a second bend 63 to route the arm 64 of the clip 60 back toward the external surface 51 of the detonator body 52, where the clip 60 electrically contacts the detonator body 52. The clip 60 in this example may comprise a spring-like material, such as a flexible steel that can maintain an elastic stress without yielding to remain biased into electrical contact with the detonator body 52. Alternatively, the clip 60 could be relatively stiff and inflexible and include a spring pivot (schematically indicated at 67 but not required in this example configuration), or the equivalent, to bias the arm 64 into engagement with the detonator body 52. The clip 60 may have sufficient strength and rigidity to also help physically secure the detonator 50 within a detonator housing as discussed below.

Figure 5:
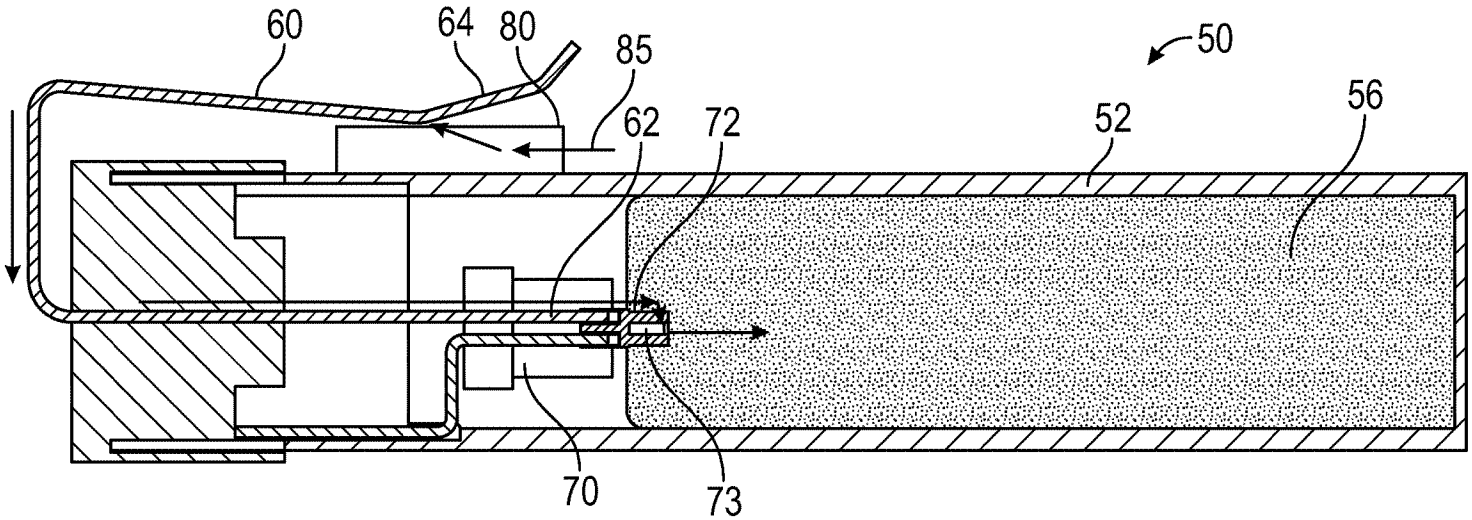
FIG. 5 is a sectional side view of the detonator with the arm of the clip moved away from the detonator body to un-shunt the detonator.

FIG. 5 is a sectional side view of the detonator 50 with the arm 64 of the clip 60 moved away from the detonator body 52 to un-shunt the detonator 50. A resultant un-shunted circuit pathway is indicated in black arrows at 85. A de-shunting member schematically indicated by a box at 80 may simulate switch components that enable firing of the detonator 50. The de-shunting member 80 may include a physical, non-conductive member that may be moved between the detonator body 52 and the arm 64 to un-shunt the detonator 50. The de-shunting member may also provide a point of electrical contact with the clip 60, which may be in electrical communication with a remote switch used to fire the detonator. The un-shunted circuit pathway 85 may extend along the electrically-conductive clip 60 from the arm 64 to where the interior portion 62 contacts the second lead 72 of the resistor initiator 70 inside the detonator body 52. The un-shunted circuit pathway 85 continues to the bridge wire 73, so that an electrical current applied along the un-shunted circuit pathway 85 (i.e., an un-shunted electrical current) may heat the bridge wire 73 to initiate explosive material 56 of the detonator 50.

Figure 6:
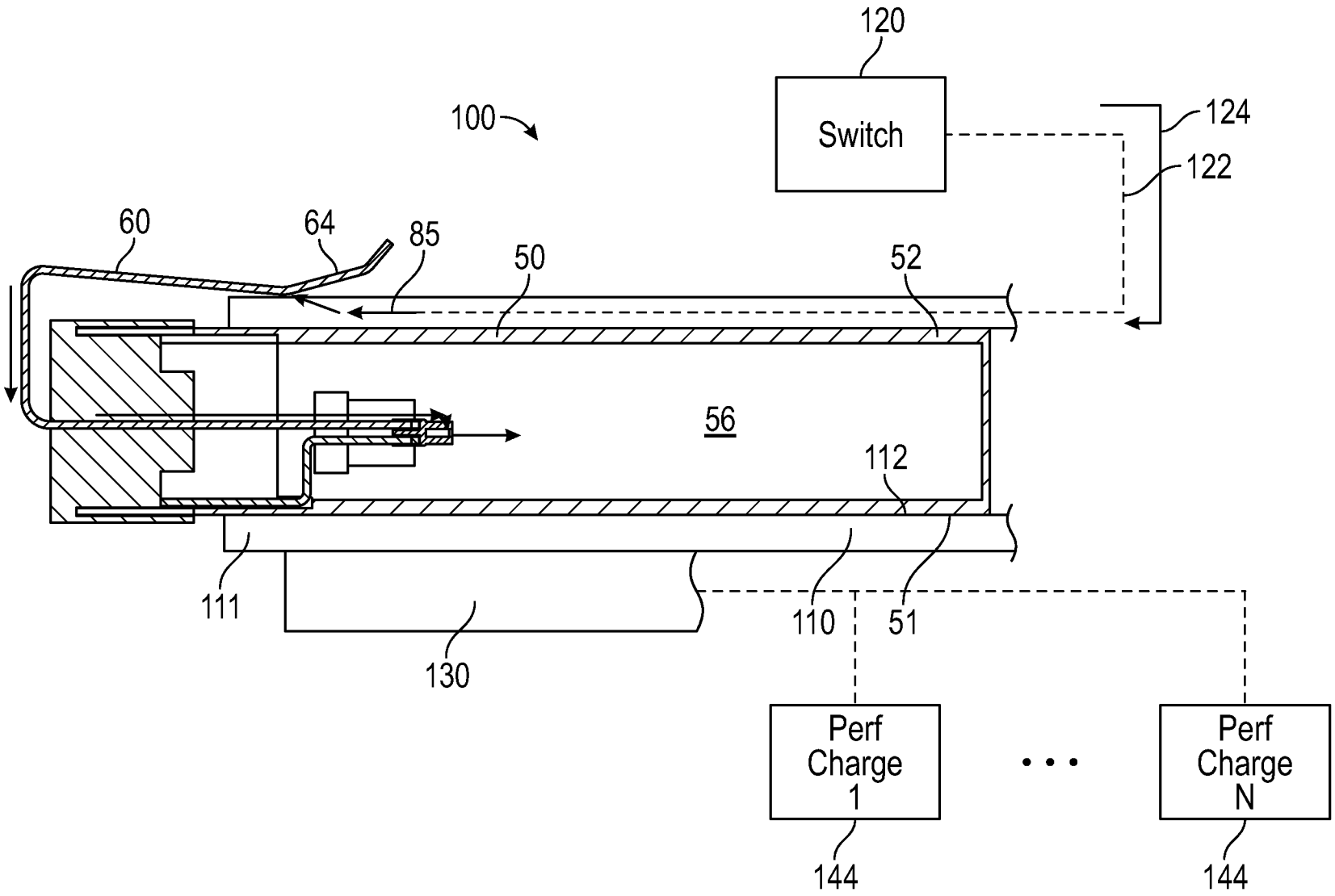
FIG. 6 is a schematic side view of a well perforating system incorporating the detonator according to an example configuration.

FIG. 6 is a schematic side view of a well perforating system 100 incorporating the detonator 50 according to an example configuration. The system 100 may integrate aspects discussed in any of the preceding figures. For example, the system 100 includes a detonator receptacle 110 defined by a detonator housing, such as the detonator housing 48 of FIG. 2 or variants thereof, for receiving the detonator body 52. The detonator 50 may be as configured in FIGS. 3-5 or variants thereof. The detonator receptacle 110 in this example is formed as an axially-extending tube or sleeve 111, and in any given configuration defines an interior 112 for slidingly receiving the detonator body 52. The sleeve 111 or other non-electrically conductive portion of the detonator body slides between the arm 64 and the detonator body 52 to urge the arm 64 of the electrically conductive clip 60 away from, and thereby out of electrical contact with, the outer surface 51 of the detonator body 52. Thus, the detonator 50 is automatically un-shunted by virtue of insertion of the detonator body 52 into the detonator receptacle 110.

The system 100 includes a remote switch 120 that is structurally separated from the detonator 50. For example, the switch 120 may be a circuit located somewhere else in the system 100 such as in another part of a perforating gun assembly, and electrically wired along the system to the detonator receptacle 110. In this example configuration, the switch 120 is not involved in un-shunting the detonator 50 since that function is automatically performed by virtue of insertion of the detonator body 52 into the detonator receptacle 110. Rather, the switch 120 may comprise a circuit that is configured to send electrical power and/or data signals to components of the system 100. In particular, the switch 120 may be used to send a detonation signal to the detonator 50 along a circuit path 122 from the switch 120 to the detonator 50. Accordingly, by plugging the detonator body 52 into the detonator receptacle 110, the detonator is un-shunted as described above as well as placed in electrical communication with the switch 120. When an operator or controller generates a detonation signal 124, the detonation signal 124 may be communicated along the circuit path 122 to the detonator 50 and along the un-shunted circuit path 85 to initiate the explosive material 56 inside the detonator body 52.

The well-perforating system 100 further includes a detonator cord (alternatively referred to as a "det cord") 130 arranged in proximity to the detonator receptacle 110. The figure shows a side-by-side arrangement of detonator cord 130 to detonator 50, by way of example, but other arrangements such as an end-to-end arrangement of a det cord and detonator are also within the scope of this disclosure. When the detonator 50 is initiated as described above, the detonation cord 130 is energized, which will fire a set of one or more ("N") perforation charges 144 that are coupled with the detonation cord 130.

Aspects of the disclosure may extend to methods that may be used to perforate a well while avoiding accidental firing of detonators prior to a deliberate well-perforating operation, such as prior to assembly of the well-perforating system components. In one example, a well-perforating safety method involves grounding a first lead of a resistor initiator to an electrically conductive detonator body housing an explosive material adjacent the resistor initiator. A second lead of the resistor initiator is coupled to an electrically-conductive clip electrically contacting an external surface of the detonator body, thereby forming a shunted circuit path bypassing the explosive material. The arm may then be moved away from the detonator body, such as by insertion of the detonator body into a detonator receptacle on a detonator housing, to switch the shunted circuit path to an un-shunted circuit path along the clip to the resistor initiator. This may urge a non-electrically conductive portion of the detonator housing between the detonator body and the clip. Once un-shunted, the detonator may be detonated by transmitting a detonation signal along the un-shunted circuit path to the detonator, thereby initiating the explosive material inside the detonator body. The detonation signal may be generated using an electrical circuit structurally separate from the detonator body.

Thus, the disclosure encompasses various systems and methods for perforating a well, with the safety of shunted circuit path and the ease and convenience of not requiring a bulky PCB to provide the shunting. These system and methods may include any suitable combination of features disclosed herein, including but not limited to the following examples.

Example 1. A detonator for a perforating gun, the detonator comprising: an electrically-conductive detonator body; a resistor initiator inside the detonator body; a grounding element inside the detonator body coupling the detonator body to a first lead of the resistor initiator; and an electrically-conductive clip having an interior portion coupled to a second lead of the resistor initiator inside the detonator body and an arm biased to electrical contact with an external surface of the detonator body to shunt the detonator, wherein the arm is moveable away from the detonator body to un-shunt the detonator.

Example 2. The detonator of Example 1, wherein the arm of the electrically-conductive clip is automatically moved away from the detonator body in response to insertion of the detonator body into the detonator housing.

Example 3. The detonator of Example 2, wherein the arm is biased toward the detonator body to secure the detonator body to the detonator housing in response to insertion of the detonator body into the detonator housing.

Example 4. The detonator of any of Examples 1 to 3, further comprising: a insulator cap closing an end of the detonator body, wherein the clip extends through the insulator cap to the resistor initiator.

Example 5. The detonator of Example 4, wherein the insulator cap overlaps with an outer diameter and inner diameter of the detonator body.

Example 6. The detonator of any of Examples 1 to 5, wherein the grounding element comprises a grounding body frictionally engaging an inner diameter of the detonator body and a grounding lead extending from the grounding body to the first lead of the resistor initiator.

Example 7. The detonator of any of Examples 1 to 6, wherein the clip is a unitary structure from the arm to an end where the clip is coupled to the second lead of the resistor initiator.

Example 8. A well-perforating system, comprising: a charge carrier for removably carrying a plurality of perforating charges; a detonator housing securable to an end of the charge carrier and including a detonator receptacle; and a detonator including an electrically-conductive detonator body receivable within the detonator receptacle of the detonator housing, a resistor initiator inside the detonator body, a grounding element inside the detonator body coupling the detonator body to a first lead of the resistor initiator, and an electrically-conductive clip electrically coupled to a second lead of the resistor initiator inside the detonator body and including an arm biased toward electrical contact with an external surface of the detonator body to shunt the detonator, wherein the arm is moveable away from the detonator body to un-shunt the detonator.

Example 9. The well-perforating system of Example 8, further comprising: a switch physically separated from the detonator body but electrically coupled to the detonator body when the detonator body is received within the detonator receptacle.

Example 10. The well-perforating system of Example 8 or 9, further comprising: a detonator cord in proximity to the detonator receptacle; and an explosive material inside the detonator body that initiates in response to an un-shunted electrical current from the clip through the resistor initiator to the explosive material.

Example 11. The well-perforating system of any of Examples 8 to 10, wherein the detonator housing comprises a non-electrically conductive portion that urges the electrically-conductive clip away from the detonator body in response to the receiving of the detonator body into the detonator housing to un-shunt the detonator.

Example 12. The well-perforating system of Example 11, wherein the arm is biased toward the detonator body to help secure the detonator to the detonator housing in response to insertion of the detonator body into the detonator housing.

Example 13. The well-perforating system of any of Examples 8 to 12, further comprising: a insulator cap closing an end of the detonator body, wherein the clip extends through the insulator cap to the resistor initiator.

Example 14. The well-perforating system of Example 13, wherein the insulator cap overlaps with an outer diameter and inner diameter of the detonator body to provide a tight fit.

Example 15. The well-perforating system of any of Examples 8 to 14, wherein the grounding element comprises a grounding body frictionally engaging an inner diameter of the detonator body and a grounding lead extending from the grounding body to the first lead of the resistor initiator.

Example 16. The well-perforating system of any of Examples 8 to 15, wherein the clip is a unitary structure from the arm to an end where the clip is coupled to the second lead of the resistor initiator.

Example 17. A well-perforating safety method, comprising: grounding a first lead of a resistor initiator to an electrically conductive detonator body housing an explosive material adjacent the resistor initiator; coupling a second lead of the resistor initiator to an electrically-conductive clip including an arm electrically contacting an external surface of the detonator body, thereby forming a shunted circuit path bypassing the explosive material; and moving the arm away from the detonator body to switch the shunted circuit path to an un-shunted circuit path along the clip to the resistor initiator.

Example 18. The method of Example 17, further comprising: transmitting a detonation signal along the un-shunted circuit path to the detonator, thereby initiating the explosive material inside the detonator body.

Example 19. The method of Example 18, wherein transmitting the detonation signal comprises generating the detonation signal using an electrical circuit structurally separate from the detonator body.

Example 20. The method of any of Examples 17 to 19, wherein moving the arm away from the detonator body comprises inserting the detonator body into a detonator housing to urge a non-electrically conductive portion of the detonator housing between the detonator body and the clip.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A detonator for a perforating gun, the detonator comprising:

an electrically-conductive detonator body;

a resistor initiator inside the detonator body;

a grounding element inside the detonator body coupling the detonator body to a first lead of the resistor initiator;

an electrically-conductive clip having an interior portion coupled to a second lead of the resistor initiator inside the detonator body and an arm biased to electrical contact with an external surface of the detonator body to shunt the detonator, wherein the arm is moveable away from the detonator body to un-shunt the detonator, and an insulator cap closing an end of the detonator body, wherein the clip extends through the insulator cap to the resistor initiator;

wherein the electrically-conductive clip is a unitary structure from the arm to an end where the clip is coupled to the second lead of the resistor initiator, and wherein the electrically-conductive clip comprises a straight section that extends from the resistor initiator to where it exits the detonator body through the insulator cap and a first bend to route the electrically-conductive clip from the insulator cap, and a second bend to route the arm of the electrically-conductive clip back toward the external surface of the detonator body, where the electrically-conductive clip electrically contacts the detonator body.

2. The detonator of claim 1, wherein the arm of the electrically-conductive clip is automatically moved away from the detonator body in response to insertion of the detonator body into the detonator housing.

3. The detonator of claim 2, wherein the arm is biased toward the detonator body to secure the detonator body to the detonator housing in response to insertion of the detonator body into the detonator housing.

4. The detonator of claim 3, wherein the insulator cap overlaps with an outer diameter and inner diameter of the detonator body.

5. The detonator of claim 1, wherein the grounding element comprises a grounding body frictionally engaging an inner diameter of the detonator body and a grounding lead extending from the grounding body to the first lead of the resistor initiator.

6. A well-perforating system, comprising:

a charge carrier for removably carrying a plurality of perforating charges;

a detonator housing securable to an end of the charge carrier and including a detonator receptacle; and a detonator including an electrically-conductive detonator body receivable within the detonator receptacle of the detonator housing, a resistor initiator inside the detonator body, a grounding element inside the detonator body coupling the detonator body to a first lead of the resistor initiator, an electrically-conductive clip electrically coupled to a second lead of the resistor initiator inside the detonator body and including an arm biased toward electrical contact with an external surface of the detonator body to shunt the detonator, wherein the arm is moveable away from the detonator body to un-shunt the detonator; and an insulator cap closing an end of the detonator body, wherein the electrically-conductive clip extends through the insulator cap to the resistor initiator, wherein the electrically-conductive clip is a unitary structure from the arm to an end where the clip is coupled to the second lead of the resistor initiator, and wherein the electrically-conductive clip comprises a straight section that extends from the resistor initiator to where it exits the detonator body through the insulator cap and a first bend to route the electrically-conductive clip from the insulator cap, and a second bend to route the arm of the electrically-conductive clip back toward the external surface of the detonator body, where the electrically-conductive clip electrically contacts the detonator body.

7. The well-perforating system of claim 6, further comprising:

a switch physically separated from the detonator body but electrically coupled to the detonator body when the detonator body is received within the detonator receptacle.

8. The well-perforating system of claim 6, further comprising:

a detonator cord in proximity to the detonator receptacle; and an explosive material inside the detonator body that initiates in response to an un-shunted electrical current from the clip through the resistor initiator to the explosive material.

9. The well-perforating system of claim 6, wherein the detonator housing comprises a non-electrically conductive portion that urges the electrically-conductive clip away from the detonator body in response to the receiving of the detonator body into the detonator housing to un-shunt the detonator.

10. The well-perforating system of claim 9, wherein the arm is biased toward the detonator body to help secure the detonator to the detonator housing in response to insertion of the detonator body into the detonator housing.

11. The well-perforating system of claim 6, wherein the insulator cap overlaps with an outer diameter and inner diameter of the detonator body to provide a tight fit.

12. The well-perforating system of claim 6, wherein the grounding element comprises a grounding body frictionally engaging an inner diameter of the detonator body and a grounding lead extending from the grounding body to the first lead of the resistor initiator.

13. The detonator of claim 1, further comprising:

a detonator receptacle; and a switch physically separated from the detonator body but electrically coupled to the detonator body when the detonator body is received within the detonator receptacle.

14. The detonator of claim 1, further comprising:

a detonator receptacle;

a detonator cord in proximity to the detonator receptacle; and an explosive material inside the detonator body that initiates in response to an un-shunted electrical current from the clip through the resistor initiator to the explosive material.

15. The detonator of claim 1, wherein the detonator housing comprises a non-electrically conductive portion that urges the electrically-conductive clip away from the detonator body in response to the receiving of the detonator body into the detonator housing to un-shunt the detonator.

16. The system of claim 6, wherein the electrically-conductive clip is automatically moved away from the detonator body in response to insertion of the detonator body into the detonator housing.

* * * * *